United States Patent [19]

Paff

[11] Patent Number: 4,527,321

[45] Date of Patent: Jul. 9, 1985

[54] RIBBON JOINT INSTALLER

[76] Inventor: Leonard L. Paff, 28468 County Rd. 26 W., Elkhart, Ind. 46517

[21] Appl. No.: 556,774

[22] Filed: Dec. 1, 1983

[51] Int. Cl.[3] ..... B23P 25/00

[52] U.S. Cl. ..... 29/33 R; 264/271.1; 425/122; 405/176

[58] Field of Search ..... 29/33 R, 33 S, 33 C; 425/122; 264/35, 271.1, 279; 405/155, 176, 180, 183, 154, 174

[56] References Cited

U.S. PATENT DOCUMENTS

| | | | |
|---|---|---|---|
| 2,314,045 | 3/1943 | Johnson | 405/176 |
| 3,652,755 | 3/1972 | Jorns | 264/35 X |
| 3,729,060 | 4/1973 | Murray | 405/155 X |
| 3,979,171 | 9/1976 | Nagy | 425/122 X |
| 4,098,636 | 7/1978 | Gabriel | 264/271.1 |
| 4,450,022 | 5/1984 | Galer | 264/279.1 |

FOREIGN PATENT DOCUMENTS

| | | | |
|---|---|---|---|
| 2302017 | 9/1976 | France | 405/176 |

*Primary Examiner*—William R. Briggs
*Attorney, Agent, or Firm*—James D. Hall

[57] ABSTRACT

A manually operable device which is for forming contraction joints in wet concrete and which includes a quantity of ribbon held within an enclosed housing. The ribbon is fed through a channel part in the device housing and into the wet concrete.

5 Claims, 6 Drawing Figures

RIBBON JOINT INSTALLER

SUMMARY OF THE INVENTION

This invention relates to a device for forming contraction joints in wet concrete.

Contraction joints are formed in concrete to allow for controlled cracking of the concrete during curing. Conventional methods of forming joints include hand tooling, sawing, and mechanical inclusion. The methods are expensive, time consuming and sometimes inefficient.

The device of this invention teaches a novel method of forming a contraction joint in wet concrete. The device includes a quantity of ribbon which is fed through a housing channel part into the wet concrete at a selected depth. The ribbon forms a thin joint within the concrete, permitting proper cracking during curing. The method is fast, efficient, and highly economical.

Accordingly, it is an object of this invention to provide a novel device for forming contraction joints in concrete.

Another object of this invention is to provide a contraction joint installer which is efficient, rapid and economical.

Another object of this invention is to provide a novel method of forming contraction joints in concrete.

Other objects will become apparent upon a reading of the following descriptions.

DESCRIPTION OF THE PREFERRED EMBODIMENTS

The preferred embodiments herein described are not intended to be exhaustive or to limit the invention to the precise forms disclosed. They are chosen and described to best explain the principles of the invention and its application and practical use to thereby enable others skilled in the art to utilize the invention.

Figure 1:
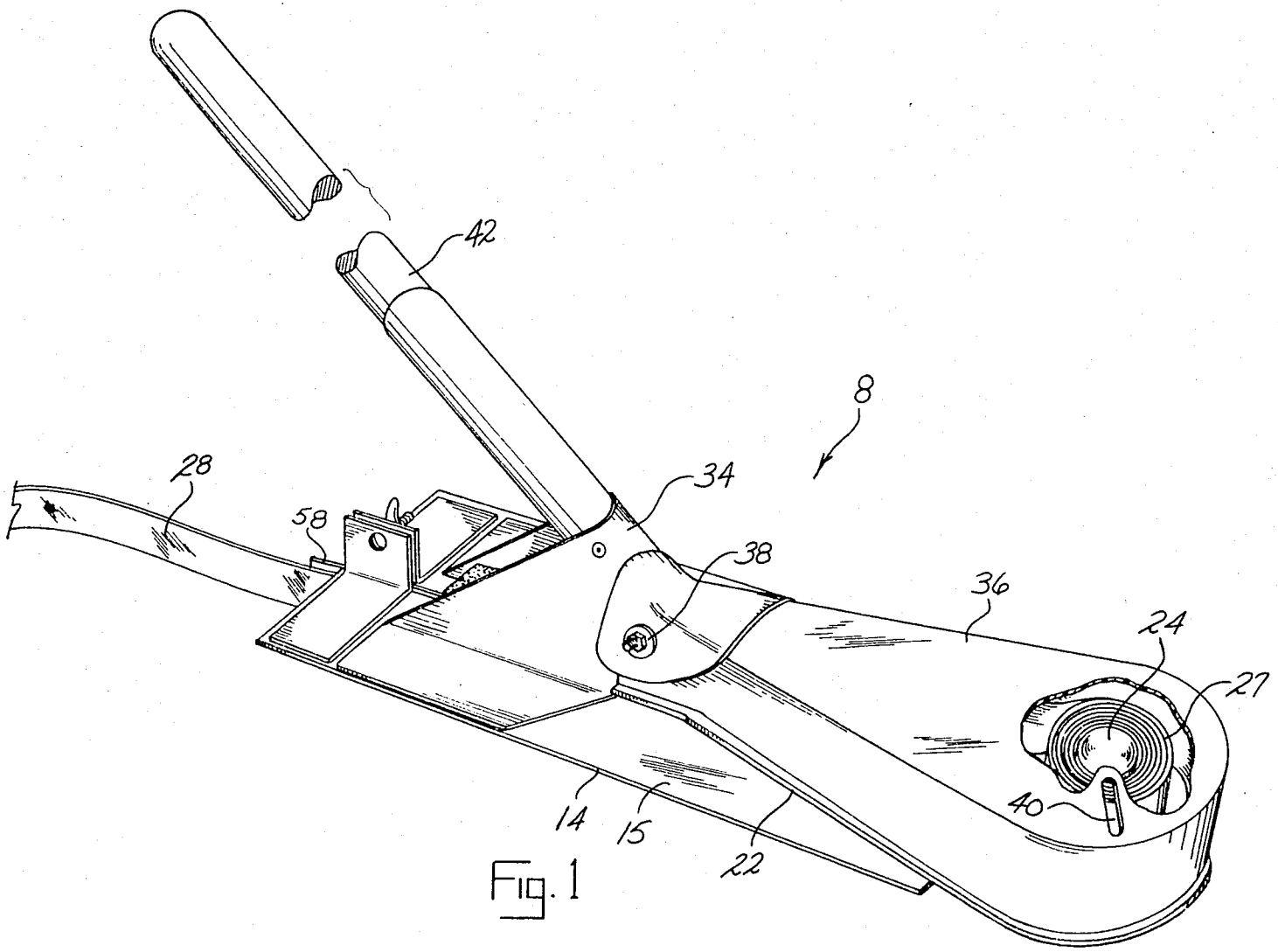
FIG. 1 is a perspective view of the ribbon joint installer of this invention.
Figure 2:
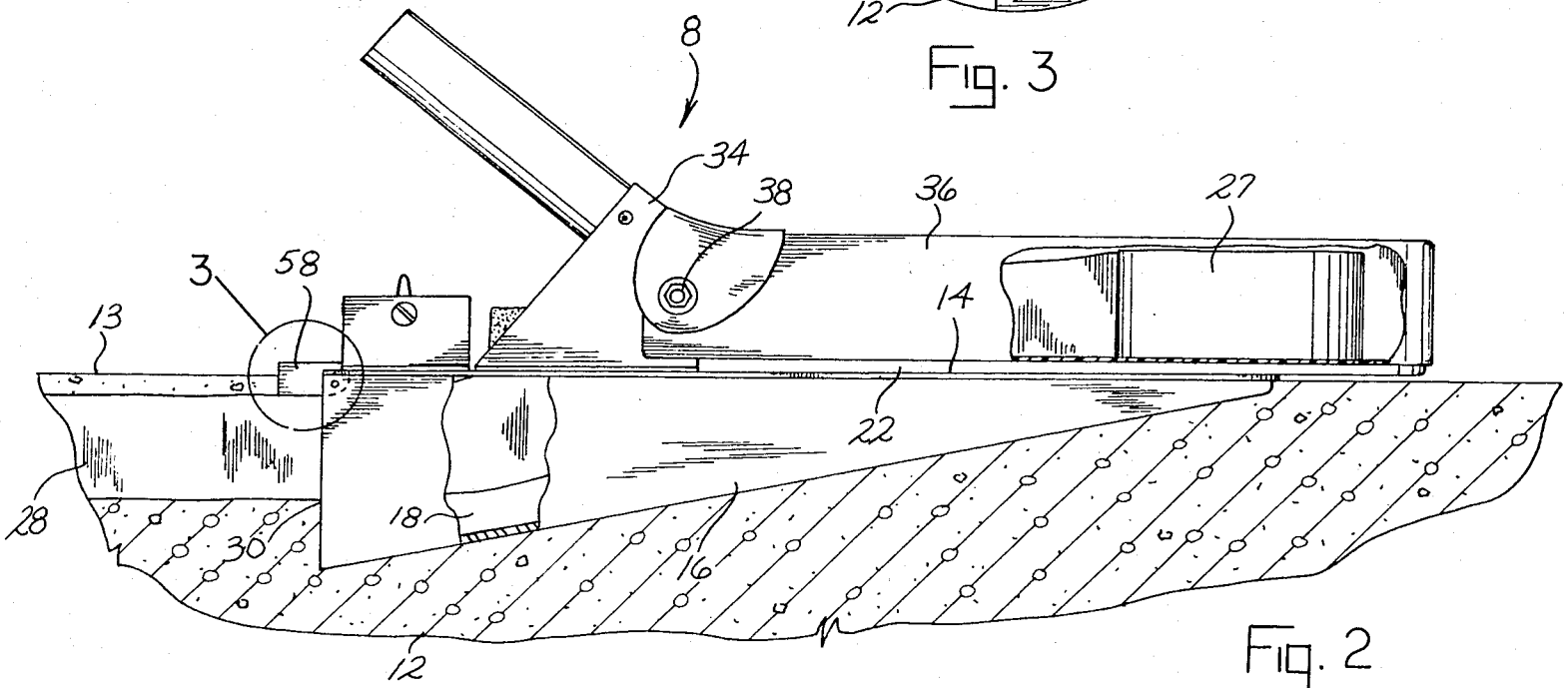
FIG. 2 is a side view showing the installer in use with a part of the cover and blade broken away for purposes of illustration.
Figure 4:
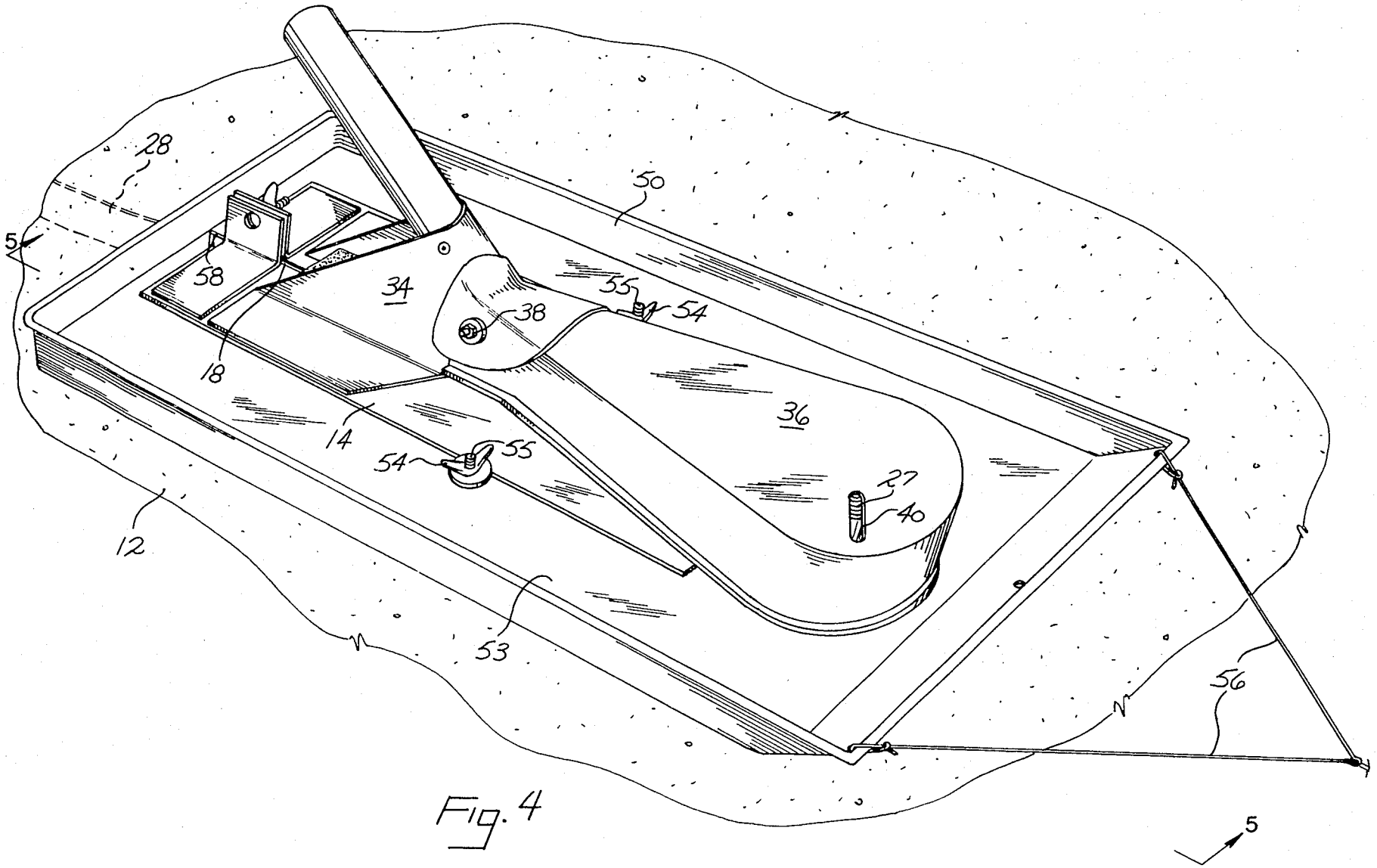
FIG. 4 is a perspective view of the joint installer being supported in a towing pan.

The contraction joint installer shown in the drawings is used to produce weakened plain joints in wet concrete. The joint installer 8 shown in FIGS. 1–2 is adapted to be pushed along the surface of wet concrete 12 to form the joint.

Installer 8 includes a metal base plate 14 and a depending central U-shaped flange portion 16 or blade. Flange portion 16 is formed to provide a rearwardly inclined longitudinal channel 18 or guide which extends from the upper face 15 of plate 14. Resting upon plate 14 is a housing 20 having a side wall 21 and a lower wall 22 which includes an upright post 24. Housing 20 is attached to plate 14 and includes a slit 26 in its lower wall 22 which is aligned with channel 18.

A mounting bracket 34 is attached to plate 14 at its upper face 15. A cover 36 is pivotally connected at 38 to bracket 34 and serves to enclose housing 20 by overlying its side wall 21 as shown in FIG. 1. Cover 36 includes a transparent window 40 which extends radially over post 24 and allows viewing of the contents inside housing 20 without lifting cover 36. An elongated handle 42 is connected at its lower end to mounting bracket 34 and extends upwardly and rearwardly from housing 20 to provide a means for manually propelling joint installer 8 across the surface of concrete 12.

A roll 27 of ribbon 28 is placed about post 24 within housing 20. The leading end of ribbon 28 extends through slit 26 in housing wall 22 and channel 18 where it protrudes through exit opening 30 of flange portion 16 at the rear of plate 14. Window 40 in cover 36 allows the user to observe the amount of ribbon remaining upon the roll 27.

Joint installer 8 is utilized as follows. With the leading end of ribbon 28 extending slightly from channel 18, the plate 14 is set upon the surface 13 of moist concrete 12 with flange portion 16 being inserted into the concrete. The user then pushes installer 8 by handle 42 across the concrete with flange portion 16 forming a furrow into which ribbon 28 is fed as it is pulled from roll 27, as seen in FIG. 2 The wet concrete closes about the inserted ribbon as installer 8 progresses across the floor to allow the ribbon to be pulled through installer flange portion 16. When the strike off is completed, the user or operator cuts the ribbon 28 adjacent exit opening 30 of the flange portion. The concrete can then be finished over if desired to cover the installed ribbon which forms a stress relief in the concrete.

Joint installer 8 may also be utilized with a tray such as pan 50, allowing the formation of longer joints. Pan 50 has a slotted opening 51 in its lower wall 53. Flange portion 16 carried by plate 14 extends through opening 51 to insure proper operation of the joint installer 8. Wing nuts 54 tightened upon screws 55, which extend through pan wall 53, serve to hold joint installer 8 firmly within pan 50.

Figure 3:
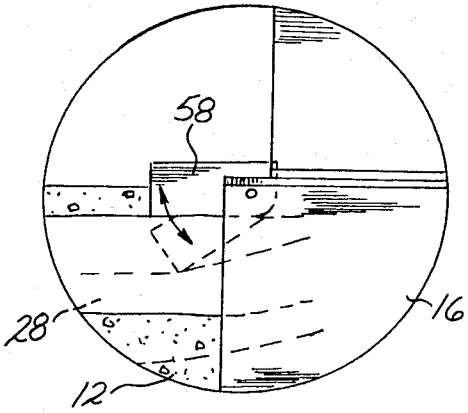
FIG. 3 is an enlarged view of that portion of the installer shown within broken line circle 3.

To utilize installer 8 and attached pan 50, a tow rope 56 is connected to the pan. Pan 50 is placed upon concrete surface 13 with the leading end of ribbon 28 set as described before. The operator then pulls on tow rope 56, drawing the pan and installer towards himself to cause ribbon 28 to form the joint as mentioned previously for the embodiment of FIGS. 1–3.

Figure 5:
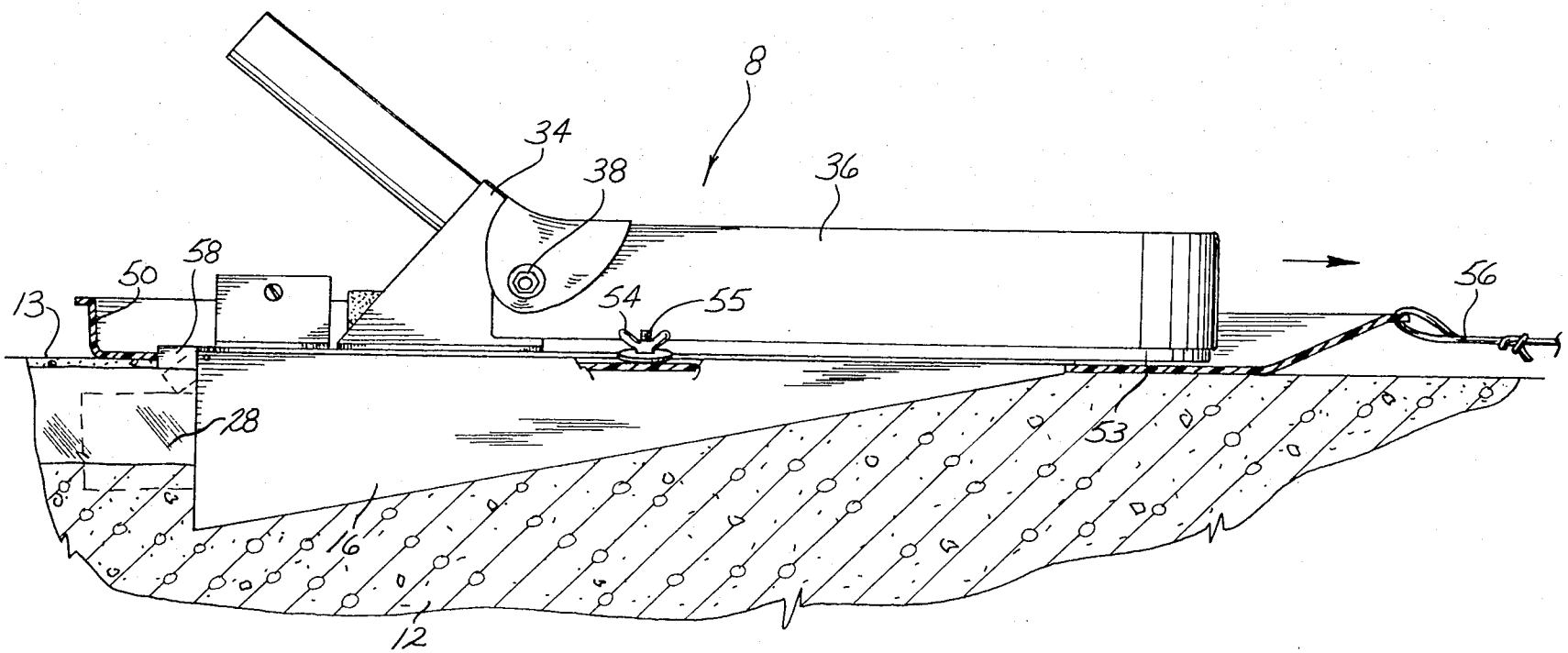
FIG. 5 is a portion sectional view taken along line 5—5 of FIG. 4 showing the installer in use, and with portions of the pan shown in fragmented form.
Figure 6:
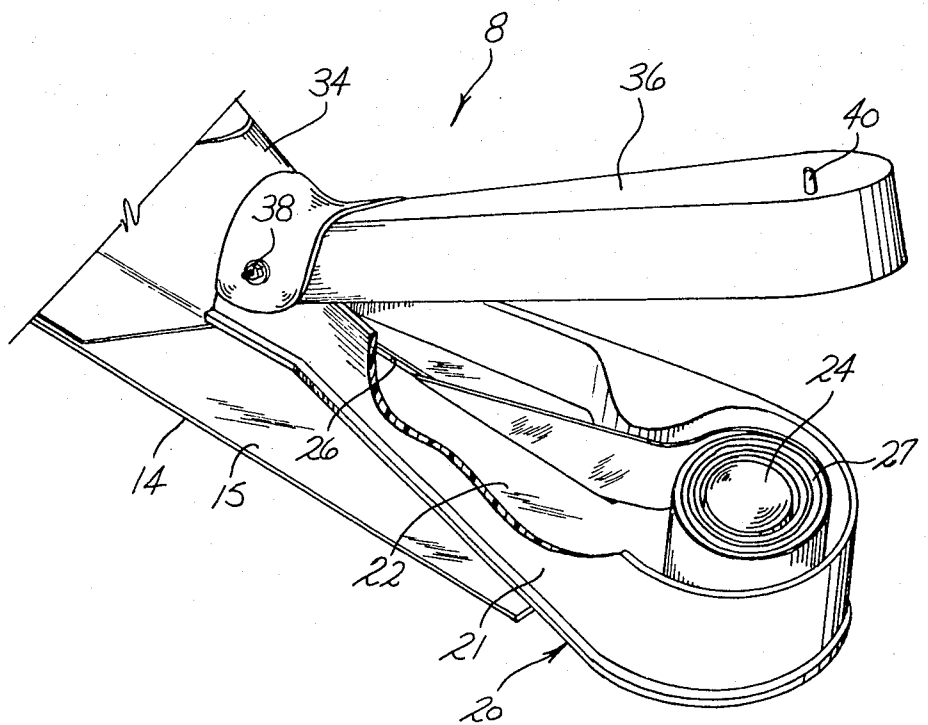
FIG. 6 is a perspective view of the installer with the cover raised and portions of the housing cut away for purpose of illustration.

Joint installer 8 includes a ribbon depth-setter 58 which takes the form of a feeler pivotally connected to flange portion 16 of the installer near the level of the plate at its exit opening 51. By varying the position of depth-setter 58, such as seen in dotted lines in FIG. 5, the operator can control the depth at which the ribbon exits plate channel 28 due to the feeler pusing the ribbon further below the surface 13 of the concrete. In this manner, the depth of the formed stress joint can be varied.

It is to be understood that the scope of the invention is not limited to the above description, but may be modified within the scope of the appended claims.

I claim:

1. Apparatus for forming contraction joints in wet concrete, said apparatus comprising a plate adapted to contact and slide across the surface of said concrete, a housing supported by said plate, a depending blade carried below said plate and defining a channel from said housing and through said blade, a supply of ribbon within said housing, said ribbon extending through said channel and exiting said blade below said plate, said blade constituting means for forming a furrow in said concrete as said plate slides across the concrete with said ribbon being pulled from said housing and positioned within said furrow, means for varying the spacing of said ribbon below said plate as it exits said blade.

2. The apparatus of claim 1 and including a handle extending generally upwardly and rearwardly from said housing.

3. The apparatus of claim 1 and a cover fitted about said housing, said cover including a transparent window portion therein whereby an operator may gauge the amount of said ribbon contained in said housing.

4. The apparatus of claim 1 and a pan, said plate and housing supported by said pan, said blade extending through said pan, said pan adapted to be towed across the surface of said concrete.

5. The apparatus of claim 4 and means for towing said pan along said concrete surface.

* * * * *